United States Patent [19]

Sellors et al.

[11] 4,013,115

[45] Mar. 22, 1977

[54] METHOD OF DIE CASTING HIGH MELTING POINT METAL

[75] Inventors: Roland George Ronald Sellors, Codsall; Raymond Cooksey, Willenhall, both of England

[73] Assignee: G.K.N. Group Services Limited, Smethwick, England

[22] Filed: Feb. 20, 1975

[21] Appl. No.: 551,436

[30] Foreign Application Priority Data

Feb. 27, 1974 United Kingdom ..... 8795/74

[52] U.S. Cl. ..... 164/51; 164/113

[51] Int. Cl.[2] ..... B22D 17/30

[58] Field of Search ..... 164/51, 80, 113, 251, 164/312

[56] References Cited

UNITED STATES PATENTS

| | | | |
|---|---|---|---|
| 3,435,878 | 4/1969 | Howard et al. | 164/51 |
| 3,615,880 | 10/1971 | Barto et al. | 164/113 X |
| 3,664,411 | 5/1972 | Carver et al. | 164/312 |

*Primary Examiner*—John E. Roethel

*Attorney, Agent, or Firm*—John C. Smith, Jr.

[57] ABSTRACT

A method of die casting high melting point metals such as ferrous metals by introducing a shot of molten metal under pressure into a die cavity in which the molten metal for each shot is produced by melting a slug in an induction furnace and wherein the melting is done in two stages in the first stage there being applied a relatively great heat input to the charge at a relatively high rate and in the second stage there being applied a reduced heat input to the charge at a reduced rate.

10 Claims, 2 Drawing Figures

METHOD OF DIE CASTING HIGH MELTING POINT METAL

BACKGROUND OF THE INVENTION

This invention relates to a method of die casting high melting point metals such as ferrous metals by introducing a shot of molten metal under pressure into a die cavity defined between separable repeatedly useable dies. The shot of molten metal is fed into the die cavity under pressure along a shot duct by a piston movable therein, the shot duct communicating at one end with the die cavity and being arranged to receive, at a receiving station spaced longitudinally of the shot duct from said one end the shot of molten metal which is transferred by the piston along the shot duct into the die cavity.

In order to provide a source of molten metal for each shot a suitable induction furnace is provided above the receiving station of the shot duct and in which a slug of solid metal is positioned so as to seal a pouring aperture in the base of the furnace. When electric current is passed through the coil of the furnace the slug is caused to melt progressively from the top downwardly, the part of the slug sealing the pouring aperture in the base of the furnace being the last to melt, and hence the slug forms its own seal until the whole of the slug is melted.

It is necessary to heat the slug rapidly in order to achieve a high rate of production. However, the quantity of heat required causes a high degree of superheat of the molten metal and a relatively large amount of turbulence in the melt. In order to achieve consistent operating conditions it is necessary to control both the degree of superheat and the turbulence. This requirement is however, in direct opposition to the rate of heat input required to achieve rapid slug melting and hence the desired rate of production.

The degree of superheat is affected by the position of the slug relative to the coil of the furnace and by the electric power input into the coil. It has, hitherto, been difficult to achieve low degrees of superheat without long melting times which reduce output.

SUMMARY OF THE INVENTION

It is accordingly an object of the present invention to provide a method of die casting high melting point metal whereby the above mentioned problem is overcome or is reduced.

According to the present invention we provide a method of die casting high melting point metal comprising the steps of introducing a solid charge into an electric induction furnace positioned above the receiving station of a shot duct which communicates with a die cavity defined between separable repeatedly useable dies, applying in a first stage of melting, a relatively great heat input to the charge at a high rate to partly melt the charge and subsequently, in a second stage of melting, starting prior to complete melting of the charge, applying a reduced heat input to the charge at a reduced rate, causing the contents of the furnace to be discharged into the shot duct when the charge is completely molten and transferring the molten metal along the shot duct to introduce the molten metal into the die cavity under pressure.

In the first stage of melting sufficient heat is applied to the charge so as to melt and superheat a part of the charge to a temperature such that, in the second stage, melting of the charge is completed whilst the degree of superheat in the completely molten charge is maintained within acceptable limits. The heat is applied in the first stage at a relatively high rate so as to obtain an acceptably short time of melting and hence an acceptably high production rate. Because of the relatively high heat input in the first stage the rate of heat input in the second stage can be reduced to a level where turbulence is maintained within acceptable limits whilst melting is completed within an acceptably short time.

By a "relatively great heat input" we mean a heat input which lies approximately in the range 100% to 60% of the total heat input to the charge and by a "reduced heat input" we mean a heat input which lies approximately in the range 0 – 40% of the total heat input and the sum of the heat inputs being such as to ensure an acceptable amount of superheat on pouring.

The total heat input per gramme can be determined by the expression:

$$H_T = H_S + L + S$$

where $H_T$ is the total heat input in calories/gramme $H_S$ is the sensible heat in calories/gramme $L$ is the latent heat of melting in calories/gramme $S$ is the heat of superheat in calories/gramme By "rate of heat input" we mean; mean heat input per unit time in calories/gramme/second.

By "reduced rate of heat input" we mean a rate which is not greater than that at which there is unacceptable turbulence of the melt in pouring; for example, about 4 cal/gramme/sec.

By a "relatively high rate of heat input" we mean a rate which is not greater than that at which there is unacceptable turbulence of the metal being melted in the furnace and which is not less than 2.5 times and is preferably not less than 7 times the reduced rate.

The charge may be positioned so that an upper part is located within the induction field obtaining within the induction coil of the furnace and a lower part projects downwardly out of the coil and said inductive field.

The heat input to the charge may be varied by varying the magnitude of the electric power supplied to the coil of the induction furnace and/or the time for which the power is applied. The rate of heat input to the charge may be governed by the magnitude of the electric power supplied to the coil.

BRIEF DESCRIPTION OF THE DRAWINGS

The invention will now be described in more detail by way of example with reference to the accompanying drawings, wherein.

DESCRIPTION OF THE PREFERRED EMBODIMENTS

Figure 1:
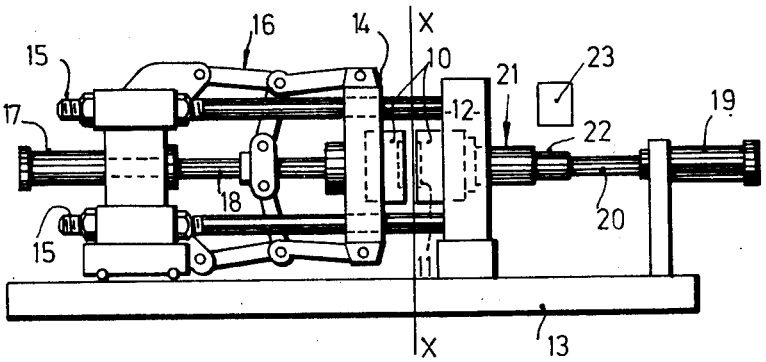
FIG. 1 is a diagrammatic illustration of a pressure die casting apparatus in which the method of the present invention can be performed.
Figure 2:
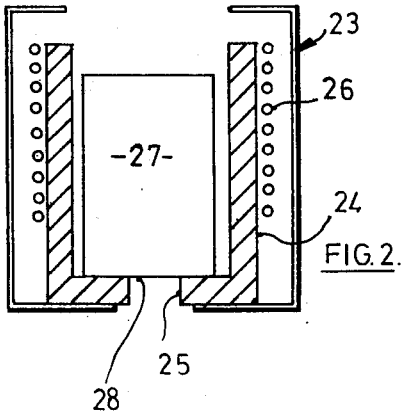
FIG. 2 is a diagrammatic illustration to an enlarged scale of the furnace of the apparatus of FIG. 1.

Referring to the FIG. 1, there is shown a die casting apparatus comprising separable repeatedly useable dies 10 which together define a die cavity 11 and which can be separated along a parting plane 'X'.

One of the dies 10 is carried in a mounting member 12 provided on a bed 13 of the apparatus. The other die 10 is movable and is carried on a slide plate 14 which is slidable along horizontally extending bars 15 which are fixed in position relative to the bed 13. The slide plate 14 is movable along the bars 15 by means of a toggle mechanism indicated generally at 16. The toggle mechanism 16 is operable by means of a piston and cylinder unit 17. A connecting rod 18 extends from the unit 17 to the toggle mechanism 16. Also fixedly mounted on the bed 13 is a piston and cylinder unit 19 having a connecting rod 20 for operation of the piston, not shown, of a shot duct 21 in conventional manner.

Molten metal is introduced into the shot duct 21 at a receiving station 22 from, an induction furnace 23. The induction furnace 23 comprises a crucible 24 having a pouring aperture 25 at its lower end positioned above the receiving station 22. The crucible is surrounded by an electric induction coil 26.

A cylindrical charge 27 to be melted is positioned within the crucible so that the lower end surface 28 of the charge closes the pouring aperture 25 and so that a lower part of the charge projects downwardly out of the coil 26 and hence out of the induction field obtaining within the coil.

In a method according to the prior art a cylindrical slug of 18/8 stainless steel and 1½ inches in diameter and weighing 0.8 Kg was introduced into the furnace 23 and heated at an electrical power input to the induction coil 26 of 50 Kw, which was substantially constant (but slightly variable as the magnetic properties of the charge changed during melting).

The electric power was applied continuously and the slug was melted 44 seconds after it was introduced into the furnace 23. The metal was found to be superheated by 110° above its melting point.

It was found that when the charge was completely molten and hence discharged itself from the furnace, the metal was very turbulent and pouring was not satisfactory, the metal tending to spray outwardly and part of the charge did not enter the receiving station 22 of the shot duct.

In a first embodiment of the invention a similar slug was heated in the induction furnace at a power input in a first stage of melting of 70 Kw. which was applied to the coil for 28 seconds at which time melting of the charge was not complete. It was determined that 245 cal/gm were applied to the slug at a rate of 8.73 cal/gm/sec. The power input was then reduced to 20 Kw and this reduced power input was applied until the charge had completely melted, which occurred at a period of 13 seconds after the power was reduced. In the second stage 33 cal/gramme were applied at a rate of 2.57 cal/gramme/sec.

The total melting time was 41 seconds and the degree of superheat obtained was 40° C. above the melting point.

The pouring operation was completely satisfactory, there being no tendency to spraying of the metal and all of the molten metal leaving the furnace entered the receiving station. A small amount of turbulence remained in the molten metal at the time of pouring, thus ensuring mixing of the charge and hence uniform temperature.

In a second example a cylindrical slug of 18/8 stainless steel 1½ inches in diameter and weighing 1.4 Kg. was used. The slug was heated by the method of the present invention and in the first stage the power input was 140 Kw for 20 seconds. It was determined that 260 cal/gramme were applied at a rate of 10.4 cal/gramme/sec. In the second stage 25 Kw was applied and the charge melted after 12 seconds. In the second stage 18 cal/gramme were applied at a rate of 1.48 cal/gramme/sec.

The melting time was 37 seconds, the degree of superheat was 40° C above the melting point and again pouring was entirely satisfactory.

In a third example a slug weighing 1 Kg. and similar to that of the first two examples was used. Initially the power input was 120 Kw applied for 25 seconds. It was determined that 261 cal/gramme were applied at a rate of 10.3 cal/gramme/sec.

Then the power input was reduced to 45 Kw. for 5 seconds. Thus in the second stage 19 cal/gramme were applied at a rate of 3.89 cal/gramme/sec.

The total melting time was 30 seconds and the degree of superheat obtained was 60° C above the melting point and again pouring was entirely satisfactory.

As a result of the above, and other tests, it has been ascertained that in the first stage between 64.5 and 447 cal/gramme may be applied at a rate lying in the range 4.3 to 14.9 cal/gramme/sec. In the second stage between 0.74 and 60 cal/gramme may be applied at a rate lying in the range 0.37 to 4.0 cal/gramme/sec. The above data is primarily applicable to stainless steels but is generally applicable to high melting point metals. It has also been determined that for a slug having a weight in the range 0.6 to 1.5 Kg. initially there should be applied a power input lying in the range 50 to 200 Kw for 15 to 30 seconds and then the power input should be reduced to a value lying in the range 5 to 40 Kw. for a time lying in the range 2 to 15 seconds.

Operation within these ranges was found to give a total melting time lying in the range 17 to 45 seconds with superheat lying in the range 20° C to 100° C.

The above quoted figures are by way of example only and it should be appreciated that they will be affected by such parameters as coil design, positioning of the slug within the coil the nature of the material of which the relevant components are made and the nature and weight of the material to be melted.

The method of the present invention not only controls the superheat but also improves the quality of the pour, there being less splashing and dripping. It is thought that this is due to the lower power input immediately prior to pouring causing less turbulence.

Although in the above examples a two step operation has been described, if desired, there may be more than one reduction in power input for example, two, three, or more reductions in power input.

In this specification the term "high melting point metals" is meant to refer to metals having a melting point which is not less than approximately 1,200° C. Typical metals are steels, cast iron, nickel, based alloys and cobalt, based alloys.

Although in the second, or final, stage the heat input may be reduced to zero it is preferred that a minimum of about 4 to 5% of the total heat input is applied in the second stage to compensate for cooling losses and to ensure a small amount of turbulence to mix the melt and maintain a constant temperature throughout the melt.

We claim:

1. A method of die casting high melting point metal comprising the steps of introducing a solid charge into an electric induction furnace positioned above the receiving station of a shot duct which communicates with a die cavity defined between separable repeatedly useable dies; applying in a first stage of melting a minimum of 60% to a maximum of about 95 – 96% of the total heat input to the charge at a relatively high rate to partly melt the charge and subsequently, in a second stage of melting, starting prior to complete melting of the charge, applying a reduced heat input ranging between a minimum of about 4 – 5% and a maximum of 40% of said total heat input to the charge at a reduced rate sufficient to maintain a small amount of turbulence in the molten metal insuring mixing of the charge and uniform temperature, the sum of said heat inputs being such as to insure an acceptable amount of super heat on pouring; causing the contents of the furnace to be discharged into the shot duct when the charge is completely molten and transferring the molten metal along the shot duct to introduce the molten metal into the die cavity under pressure.

2. A method according to claim 1 wherein the solid charge is positioned so that an upper part is located within the induction field obtaining within the induction coil of the furnace and a lower part projects downwardly out of the coil and said induction field.

3. A method according to claim 1 wherein the solid charge is positioned within the furnace so as to seal a pouring aperture in the base of the furnace and wherein the charge is caused to melt progressively from the top downwardly, the part of the charge sealing the pouring aperture in the base of the furnace being the last to melt whereby the charge forms its own seal until the whole of the charge has melted.

4. A method according to claim 1 comprising applying heat input to said charge in said first stage of melting at a rate not less than 2.5 times the rate heat input is applied to said charge in said second stage.

5. A method according to claim 4 comprising applying heat input to said charge in said first stage of melting at a rate not less than 7 times the rate heat input is applied to said charge in said second stage.

6. A method of die casting high melting point metal comprising the steps of introducing a solid charge into an electric induction furnace positioned above the receiving station of a shot duct which communicates with a die cavity defined between separable repeatedly useable dies; applying in a first stage of melting between 64.5 and 447 cal/gramme at a rate lying in the range 4.3 to 14.9 cal/gramme/second to partly melt the charge and subsequently, in a second stage of melting, starting prior to complete melting of the charge, applying between 0.74 and 60 cal/gramme at a rate lying in the range 0.37 to 4.0 cal/gramme/sec.; causing the contents of the furnace to be discharged into the shot duct when the charge is completely molten and transferring the molten metal along the shot duct to introduce the molten metal into the die cavity under pressure.

7. A method according to claim 6 wherein the charge is positioned within the furnace so as to seal a pouring aperture in the base of the furnace and wherein the charge is caused to melt progressively from the top downwardly, the part of the charge sealing the pouring aperture in the base of the furnace being the last to melt whereby the charge forms its own seal until the whole of the charge has melted.

8. A method of die casting high melting point metal comprising the steps of introducing a solid charge having a weight lying in the range 0.6 to 1.5 kg. into an electric induction furnace positioned above the receiving station of a shot duct which communicates with a die cavity defined between separable repeatedly useable dies; applying to the electrical induction furnace in a first stage of melting an electrical power input lying in the range from 50 to 200 kw for a period of time lying in the range 15 to 30 seconds to partly melt the charge and subsequently, in a second stage of melting, applying an electrical power input lying in the range 5 to 40 kw for a time lying in the range 2 to 15 seconds; causing the contents of the furnace to be discharged into the shot duct when the charge is completely molten and transferring the molten metal along the shot duct to introduce the molten metal into the die cavity under pressure.

9. A method according to claim 8 wherein the charge is positioned within the furnace so as to seal a pouring aperture in the base of the furnace and wherein the charge is caused to melt progressively from the top downwardly, the part of the charge sealing the pouring aperture in the base of the furnace being the last to melt whereby the charge forms its own seal until the whole of the charge has melted.

10. A method according to claim 8 wherein the charge is a stainless steel slug.

* * * * *